US008757927B2

(12) United States Patent
Schubert et al.

(10) Patent No.: US 8,757,927 B2
(45) Date of Patent: Jun. 24, 2014

(54) GRAVITY-FED BASIN

(75) Inventors: Falko Schubert, Forchheim (DE); Hubert Schäferlein, Höchstadt (DE)

(73) Assignee: Siemens Aktiengesellschaft, München (DE)

( * ) Notice: Subject to any disclaimer, the term of this patent is extended or adjusted under 35 U.S.C. 154(b) by 59 days.

(21) Appl. No.: 13/391,333

(22) PCT Filed: Aug. 20, 2010

(86) PCT No.: PCT/EP2010/062142
§ 371 (c)(1), (2), (4) Date: Feb. 20, 2012

(87) PCT Pub. No.: WO2011/020905
PCT Pub. Date: Feb. 24, 2011

(65) Prior Publication Data

US 2012/0155965 A1 Jun. 21, 2012

(30) Foreign Application Priority Data

Aug. 21, 2009 (EP) ..... 09168355

(51) Int. Cl.
*E02B 3/00* (2006.01)

(52) U.S. Cl.
USPC ..... 405/80; 405/127; 210/747.2

(58) Field of Classification Search
CPC ..... E03F 1/002; E03F 5/107; E03F 1/001; E03F 1/005; E03F 5/10; E03F 5/105; E03F 5/12; E03F 5/125
USPC ..... 405/36, 50, 80, 127; 210/747.1, 747.2
See application file for complete search history.

(56) References Cited

U.S. PATENT DOCUMENTS

| | | | | |
|---|---|---|---|---|
| 3,791,444 | A | 2/1974 | Hickey | |
| 4,261,823 | A * | 4/1981 | Gallagher et al. | 210/164 |
| 5,759,415 | A * | 6/1998 | Adams | 210/776 |
| 7,138,048 | B1 * | 11/2006 | O'Connor et al. | 210/136 |
| 2004/0074846 | A1 * | 4/2004 | Stever et al. | 210/747 |
| 2008/0190828 | A1 * | 8/2008 | Schaferlein | 210/116 |

FOREIGN PATENT DOCUMENTS

| | | | |
|---|---|---|---|
| CN | 201307247 | Y | 9/2009 |
| DE | 3103306 | A1 | 8/1982 |
| EP | 0503209 | A1 | 9/1992 |
| EP | 1693094 | | 8/2006 |
| GB | 699491 | A | 11/1953 |
| SU | 1332273 | A1 | 8/1987 |

* cited by examiner

*Primary Examiner* — Benjamin Fiorello

(57) ABSTRACT

A device for discharging industrial water into a receiving body of water is provided. The device includes a gravity-fed basin having a gravity cylinder, the gravity cylinder includes an inlet opening and an outlet opening, the inlet opening forming an overflow crest. A throttle member connected to a float gauge by means of a guide rod is disposed inside the gravity cylinder and vertical swirl vanes are disposed between the gravity-fed basin and the gravity cylinder.

5 Claims, 4 Drawing Sheets

GRAVITY-FED BASIN

CROSS REFERENCE TO RELATED APPLICATIONS

This application is the US National Stage of International Application No. PCT/EP2010/062142, filed Aug. 20, 2009 and claims the benefit thereof. The International Application claims the benefits of European Patent Office application No. 09168355. EP filed Aug. 21, 2009. All of the applications are incorporated by reference herein in their entirety.

FIELD OF INVENTION

The present invention relates to a device for discharging industrial water, especially cooling water of a power plant, into a receiving body of water.

BACKGROUND OF INVENTION

In power plants cooled with fresh water the industrial water is discharged for operational reasons via a gravity-fed basin into a receiving body of water. A receiving body of water is to be understood as standing or flowing water into which the industrial water is discharged.

GB 699 491 A discloses a regulating device which is to be used as a bypass in a hydro power plant. The proposed regulation device is designed to enable a constant industrial water level to be set in a gravity-fed basin for varying flow rates of industrial water. To this end a throttle member is connected axially to a float gauge at the industrial water level, so that the throttle member is opened if the industrial water level rises and industrial water will be fed by gravity into a receiving body of water. However the throttle member by itself is too slow for rapid regulation of the industrial water level. Depending on the type of power plant, the flow quantity of industrial water through the gravity-fed basin, depending on the allowed temperature rise of the industrial water, amounts to around 5 to 10 $m^3$ per second. The regulation device is also not able to deal with fluctuations in the industrial water flow rate so that fluctuations in the water level of the receiving body of water can be avoided. Fluctuations in the water level of the receiving body can be problematical for gravity-feed operation of the gravity-fed basin. Fluctuations especially occur as a result of regulated pumps or a number of pumps delivering into a gravity-fed basin.

Strong fluctuations of the industrial water level can be countered by the provision of overflow crests. For this purpose the gravity-feed basin comprises a water basin with a crest over which the industrial water is introduced into the receiving body of water. Only when the water level exceeds the height of the crest is the industrial water discharged into the receiving body of water. Depending on fluctuations in the water level of the receiving body, the water flowing over the crest falls many meters downwards in order to mix with the water of the receiving body. The crest can be formed as a linear crest or for example by the upper edge of a gravity cylinder rising from the floor of the basin, as is described for example in DE 31 03 306.

The gravity cylinder described in DE 31 03 306 serves to discharge waste water, e.g. from a power plant, through a gravity-fed basin into surface water. In this invention numerous vertically-aligned guide plates are provided in the gravity cylinder, through which the amount of air introduced into the industrial water is to be increased, so that the industrial water to be discharged will be enriched with oxygen.

Even if no measures are provided for feeding air into the industrial water, a large amount of air is introduced when the water falls vertically which, depending on the water quality, leads to foam formation to a greater or lesser degree. This introduction of air or formation of foam is generally unwelcome both for authorities and for local residents.

Under certain circumstances there is also the danger of stable foam forming which can also lead to significant operational difficulties.

Measures which are designed to reduce the introduction or air or the formation or foam are therefore generally tried out and tested during the commissioning of a gravity-fed basin. Such measures might include temporary coverings, the injection of chemicals or venting or pipe systems. The latter in particular can result in enormous additional costs. There can also be recourse in such systems to fixtures based on different principles.

To reduce foam formation EP 1 693 094 proposes specially-embodied cylindrical gravity cylinders. Foam formation is to be avoided in such cylinders by the exit opening of the gravity cylinder being arranged below the liquid level of the receiving body of water and also by plates being arranged horizontally in the gravity cylinder to provide flow resistance. Such fixtures can only be optimized in these cases to specific ranges of water level for example. With fluctuating amounts of industrial water permanent fixtures present a risk of malfunctions. In addition, especially the gravity-fed basins with various fixtures to some extent need a comparatively large area.

When a gravity-fed cylinder is used there is also the danger of a vortex which is caused by a swirling of the water flowing into the gravity-fed cylinder. A swirl generally leads to eddies in flowing water, which in its turn leads to increased aeration.

SUMMARY OF INVENTION

The object of the present invention is to provide an advantageous gravity-fed basin compared to the prior art which, even with fluctuating flow rates of industrial water, guarantees gravity-fed operation with at the same time minimal formation of foam.

This object is achieved by a device for discharging industrial water into a receiving body of water as claimed in the claims. The independent claims contain advantageous embodiments of the inventive device.

The inventive device for discharging industrial water into a receiving body of water comprises a gravity-fed basin with a gravity cylinder having an inlet opening and an outlet opening. In this case the inlet opening forms an overflow crest. In the inventive device there is a throttle member inside the gravity cylinder connected to a float gauge via a guide rod. The device can especially be embodied for discharging cooling water of a power plant. In addition vertical swirl plates are arranged between the gravity-fed basin and the gravity cylinder.

The underlying idea of the invention here is to use the advantages of a device of a gravity-fed basin with a compact design and in addition to make the device suitable for constant and sharply fluctuating flow rates of industrial water. To this end a gravity cylinder, which has an adjustable discharge throttle device, is provided in the gravity-fed basin.

During operation the throttle member of the discharge throttle device is actuated via the guide rod by the float gauge. Fluctuating water mass flows in the supply on the one hand and also a fluctuating water level in the receiving body are equalized by the discharge throttle device. With an increasing water mass flow in the supply, the float gauge, like a buoy, experiences a buoyancy effect and actuates the throttle member via the guide rod, which discharges the water under the force of gravity into the receiving body of water. As the water mass flow decreases in the supply the water level in the gravity-fed basin also falls and the throttle member is throttled or closed by the float gauge. The discharge throttle device behaves in a similar manner for a rising or falling water level in the receiving body of water. The inventive device for discharging industrial water into a receiving body of water thus guarantees gravity-fed operation for a very large bandwidth of variable industrial water mass flows. This avoids formation of foam through aeration even with sharp fluctuations in industrial water flow rates.

In addition a number of vertical swirl plates are arranged between the gravity-fed basin and the gravity cylinder. The swirl panels or also swirl plates reduce the swirl of the incoming cooling water and thereby largely avoid a vortex in the gravity cylinder. A number of swirl plates can be provided for this purpose around the circumference of the gravity cylinder. The task of the swirl plate is to counter a swirl during inflow of the water into the gravity cylinder.

To counter the introduction of air and thus a formation of foam, as an alternative to the swirl plates, a swirl-breaking element, especially a swirl cross, can be arranged in the area of the inlet opening of the gravity cylinder.

Compared to gravity-fed basins with a linear crest the inventive gravity-fed basin thus needs significantly fewer surface fixtures. The space for fixtures can be reduced by around 40% compared to a gravity-fed basin with a linear crest. Compared to gravity-fed basins with fixtures, cost intensive building measures can be avoided by the inventive device.

A gravity-fed basin can also be designed such that retrofitting with the inventive device for discharging industrial water into a receiving body of water can be carried out in subsequent operation of the power plant, if in the planning phase or at the beginning of construction the scope of the industrial water flow rate is unclear.

In an advantageous embodiment of the device for discharging industrial water into a receiving body of water the throttle member has a fixed element at the outlet opening and a movable element connected to the fixed element with the guide rod. The guide rod is connected to the float gauge. During operation of the gravity-fed basin the float gauge moves as a function of the flow rate of industrial water and causes an adjustment of the movable element of the throttle member. This avoids formation of foam even with fluctuating flow rates of industrial water.

Especially good results can be obtained if the fixed element of the throttle member has annular or elongated outlet openings. A sufficient stability of the component with simultaneously efficient conveying of the cooling water is guaranteed by openings of this type. However other forms such as slot-shaped openings or an embodiment of the fixed element as a grating are also conceivable.

As a result of the large dimension of the device it proves advantageous to provide suitable play between the fixed element and the movable element of the throttle member so that sticking as result of a possible slightly inclined guidance of the movable element relative to the fixed element is avoided. Seals can be dispensed with. It is even advantageous to explicitly provide holes or openings so that, even with the throttle member closed, a minimum throughput of cooling water mass flow is provided.

Advantageously the gravity-fed basin has an overflow outlet arranged above the overflow crest. This avoids an uncontrolled overflow or congestion resulting from too high flow rates or strong fluctuations in flow rates.

In a particular development the gravity-fed basin has a safety element through which the guide rod is vertically centered in its movement. The safety element is above all advantageous if guide elements of the guide rod are dispensed with within the gravity cylinder. The safety element avoids the component falling over and in particular the movable element binding with the fixed element of the throttle member.

In an advantageous embodiment the outlet opening of the gravity cylinder is located below the fluid level of the receiving body of water. This prevents air being introduced by the receiving body of water into the gravity cylinder. Depending on requirements or the given constraints it can however also be necessary to allow an arrangement of the outlet opening of the gravity cylinder above the receiving body of water.

BRIEF DESCRIPTION OF THE DRAWINGS

The invention will be explained with reference to exemplary embodiments in FIGS. 1 to 4, in which.

DETAILED DESCRIPTION OF INVENTION

Figure 1:
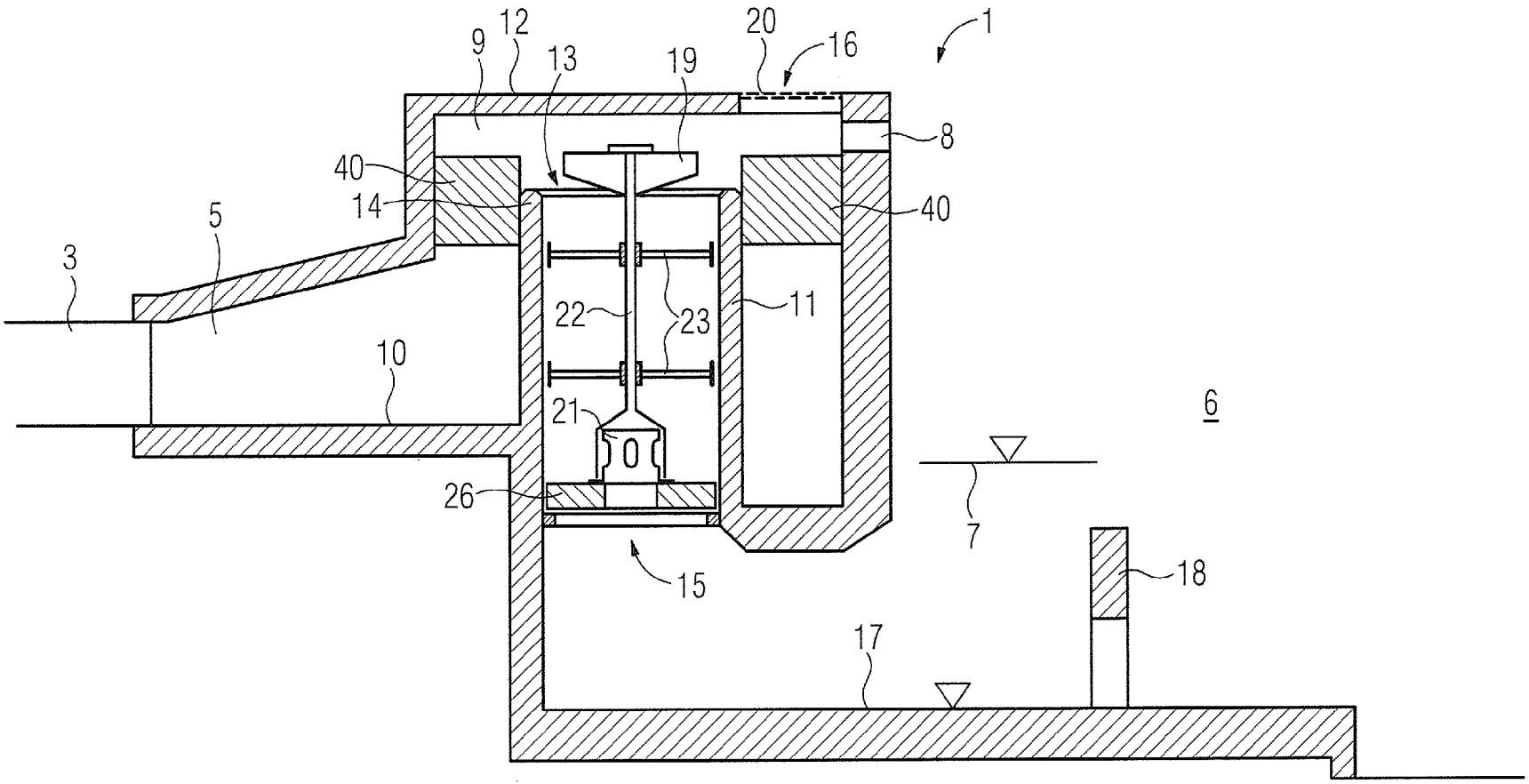
FIG. 1 shows a device for discharging industrial water into a receiving body of water with a float gauge and throttle member in a sectional side view.
Figure 2:
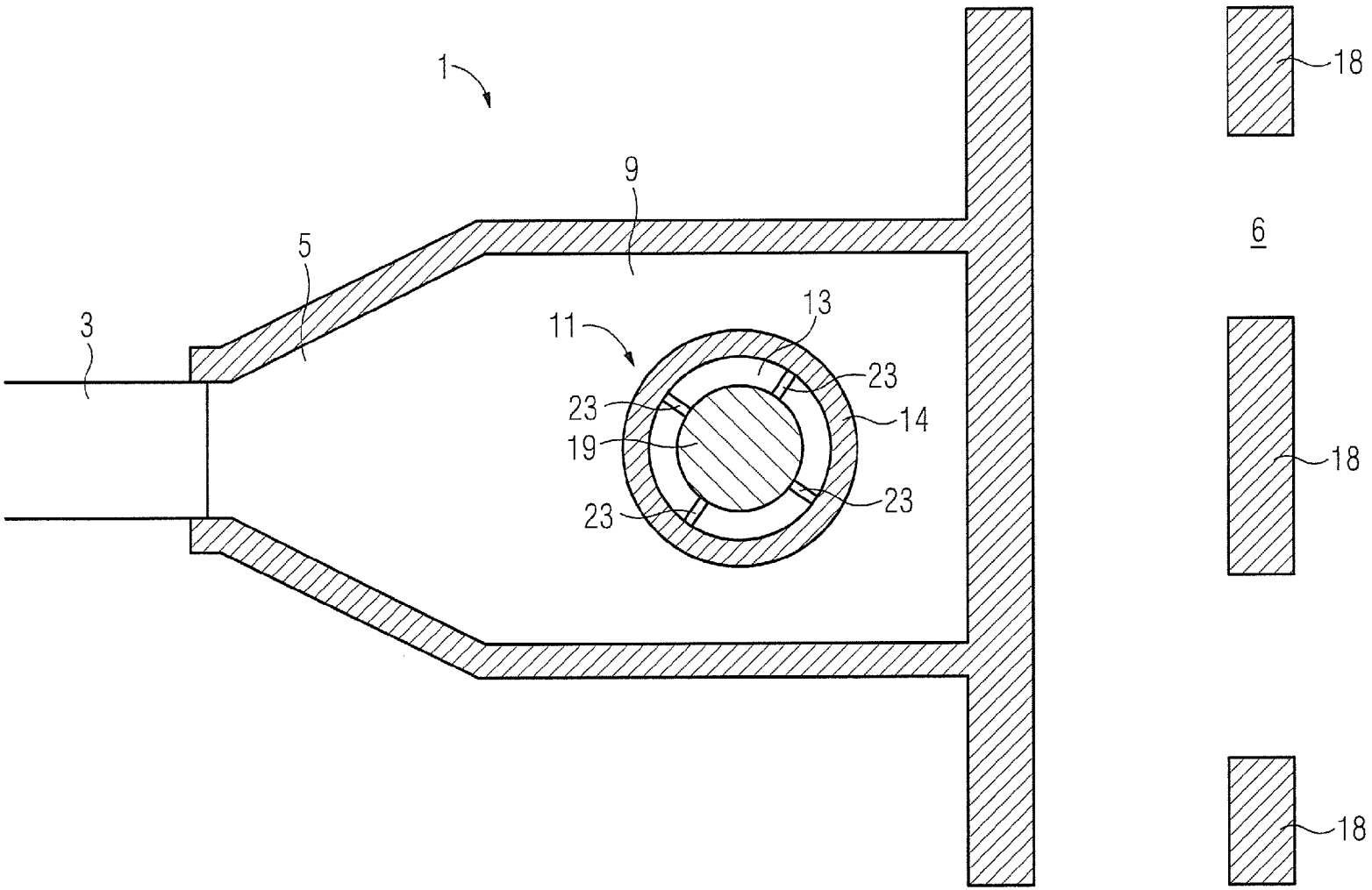
FIG. 2 shows a device for discharging industrial water into a receiving body of water with a float gauge and throttle member in a sectional view from above.

FIGS. 1 and 2 show a device for discharging industrial water into a receiving body of water 6. FIG. 1 shows the device in a gravity cross section while FIG. 2 shows the device in a horizontal section from above.

The device for discharging industrial water into a receiving body of water 6 essentially comprises a gravity-fed basin 1.

The gravity fed basin 1 is connected to a supply line 3 through which industrial water, for example cooling water of a power plant, flows into the gravity-fed basin 1. The gravity-fed basin 1 is also in contact in terms of flow with the receiving body of water 6, the water level of which is indicated by the line 7 and into which the industrial water is introduced.

The gravity-fed basin 1 comprises an expansion chamber 5, a water basin 9 which is covered by a cover plate 12 and a gravity cylinder 11, of which the inlet opening 13 is arranged at a distance above the floor 10 of the water basin 9. The outlet opening 15 of the gravity cylinder 11 is located below the water level line 7 of the receiving body of water 6. A floor plate 17 from which a number of swirl plates 18 project upwards is present at a distance from the outlet opening 15. The outlet speed of the industrial water into the receiving body of water beyond the swirl plates 18 amounts to less than 0.3 m/s.

To make it possible to inspect the basin by climbing into it, an opening 16 is present in the cover plate 12. The inspection opening 16 is closed off by a cover grating 20. The gravity-fed basin 1 also has an overflow outlet 8 which protects against the gravity-fed basin 1 overflowing in exceptional cases.

The upper edge of the gravity cylinder 11, i.e. the limitation of the inlet opening 13, forms an overflow crest 14 for the industrial water held in the water basin 9. The industrial water flows over this overflow crest 14 into the gravity cylinder 11.

Inside the gravity cylinder 11 there is a float gauge 19 which is connected via a guide rod 22 to a throttle member 21. The guide rod 22 is guided vertically by guide elements 23.

Between the housing of the gravity-fed basin 1 and the gravity cylinder 11 a number of swirl plates 40 are arranged around the circumference. A swirl cross can be arranged as an alternative to the swirl plates 40 in the inlet opening 13, which is intended to prevent the formation of an eddy in the industrial water flowing through the gravity cylinder 11.

The throttle member 21 forms a flow resistance which leads to a buildup of water, which reduces the flow speed of the industrial water in the gravity cylinder 11 such that the so-called characteristic separation speed is reached or undershot. For a flow speed which is less than or equal to the characteristic separation speed, the air bubbles and the water can separate, so that the air bubbles rise in the gravity cylinder 11 and can reach the water surface. In the area of the outlet opening 15 the air content of the industrial water is thus reduced by comparison with a gravity cylinder without adjustable throttle member 21.

Figure 3:
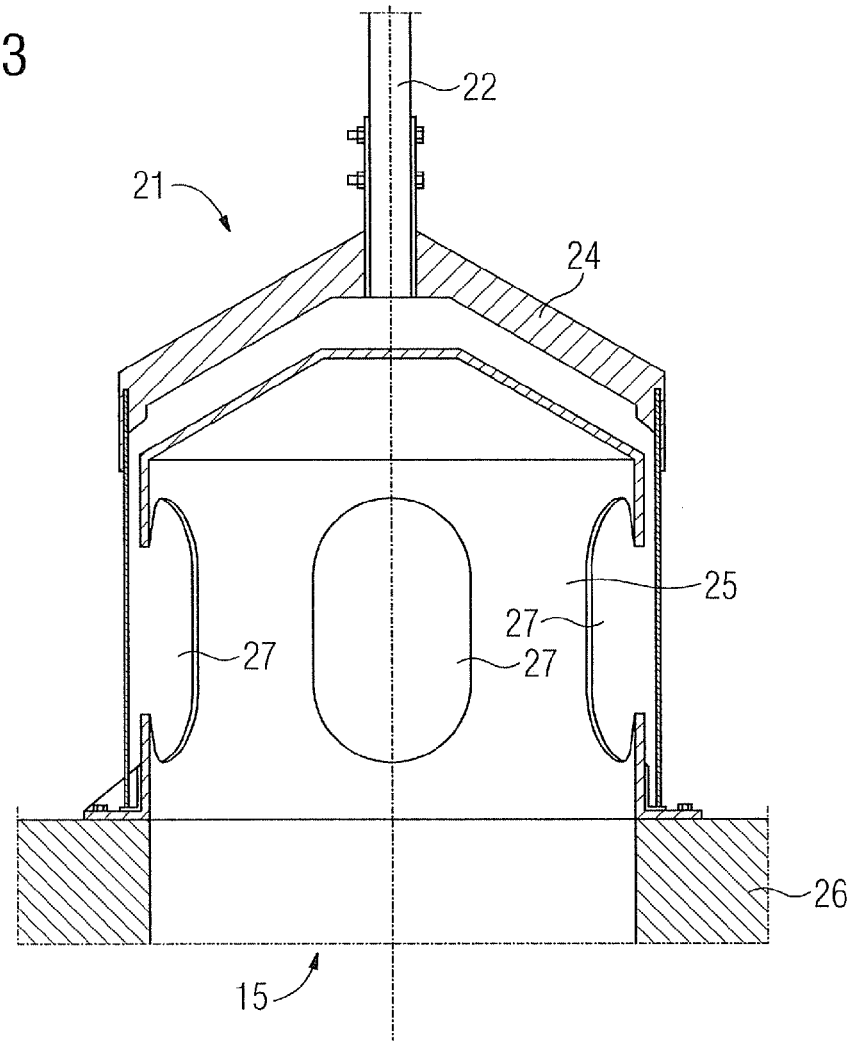
FIG. 3 shows a throttle member in a sectional side view.
Figure 4:
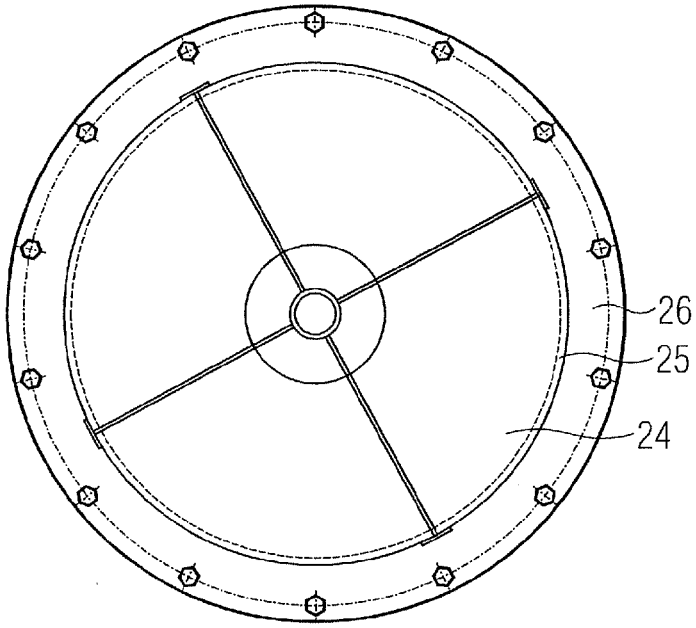
FIG. 4 shows a throttle member in a sectional view from above.

A possible form of throttle member is shown in FIGS. 3 and 4. FIG. 3 shows a throttle member 21 in a sectional view from the side, FIG. 4 a throttle member 21 in a view from above.

The throttle member 21 consists of a movable element 24 and a fixed element 25. The movable element is shaped like a bell and is connected to the guide rod 22. The movable element 24 is movable through the vertical plane in relation to the fixed element 25. The fixed element 25 has openings 27, and is connected to a floor element 26 which delimits the gravity cylinder 11 downwards. In the area of the fixed element 25 the floor element 26 has a cutout which forms the outlet opening 15.

If the movable element 24 is moved completely above the fixed element 25, the throttle member 21 is completely closed. If the movable element 24 is pulled upwards by the float gauge 19, the openings 27 of the fixed element 25 are completely or partly opened and industrial water can flow out.

Further faints of the throttle member 21 are conceivable. By selecting suitable dimensions and forms of the throttle member 21 the introduction of air into the industrial water falling through the gravity cylinder 11 can be minimized. The form and dimensions of the throttle member can be optimized empirically.

Figure 5:
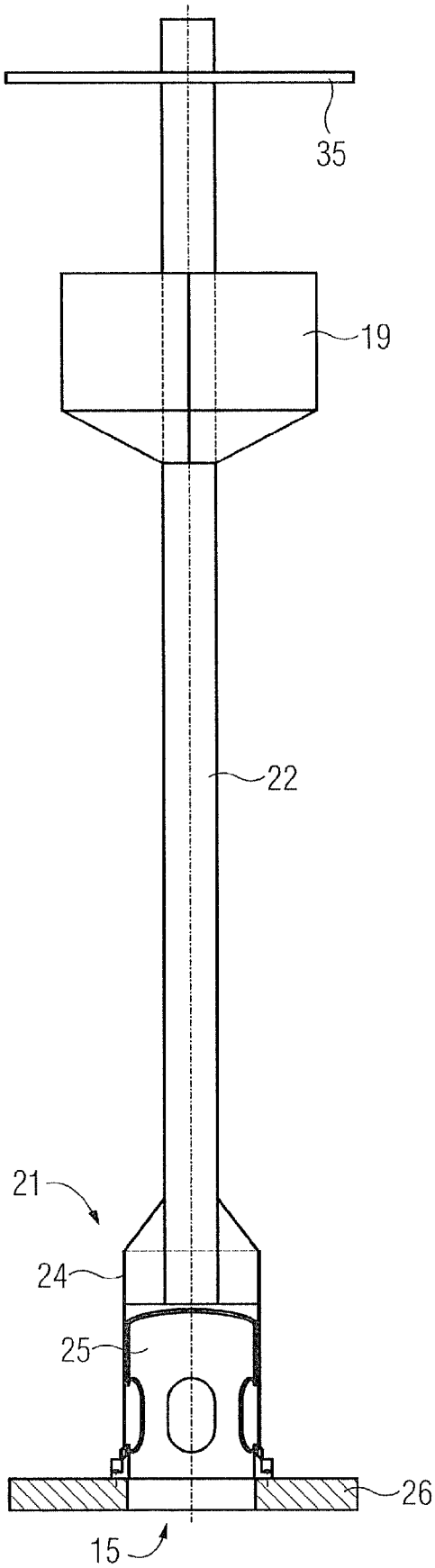
FIG. 5 shows a module comprising throttle member, guide rod, float gauge and safety element.

FIG. 5 shows a side view of a module comprising throttle member 21, guide rod 22, float gauge 19 and safety element 35. The module is arranged within the gravity cylinder. In this diagram the guide rod is not secured by guide elements in the gravity cylinder 11. In operation i.e. when the gravity cylinder is full of water, the guide rod 22 will be centered vertically by the buoyancy of the float gauge 19. However in particular operating states, e.g. when the power plant is started up or with sharp fluctuations in the flow of cooling water, to avoid the fixed element 24 binding with the movable element 25 of the throttle member 21, the safety element 35 is provided, which centers the guide rod 22 vertically. The safety element 35 is connected to the housing of the gravity-fed basin and has an opening or a guide in which the guide rod is guided vertically.

The invention claimed is:

1. A device for discharging industrial water into a receiving body of water, comprising:

a gravity-fed basin with a gravity cylinder having an inlet opening and an outlet opening wherein the inlet opening forms an overflow crest;

a throttle member connected to a float gauge via a guide rod is arranged inside the gravity cylinder;

a plurality of vertical swirl plates arranged between the gravity-fed basin and gravity cylinder wherein the swirl plates reduce a swirl of incoming industrial water, and wherein the gravity-fed basin includes an overflow outlet arranged above the overflow crest.

2. The device as claimed in claim 1, wherein the throttle member comprises a fixed element at the outlet opening and a movable element connected to the fixed element with the guide rod.

3. The device as claimed in claim 2, wherein a plurality of annular outlet openings are arranged in the fixed element of the throttle member.

4. The device as claimed in claim 1, wherein the gravity-fed basin includes a safety element through which the guide rod is centered vertically.

5. The device as claimed in claim 1, wherein the outlet opening of the gravity cylinder is arranged below the liquid level of the receiving body of water.

* * * * *